US008225466B2

(12) United States Patent
Takani et al.

(10) Patent No.: US 8,225,466 B2
(45) Date of Patent: Jul. 24, 2012

(54) SLIDER FOR CONCEALED TYPE SLIDE FASTENER WITH SEPARABLE BOTTOM END STOP

(75) Inventors: Go Takani, Toyama-ken (JP); Takanori Ozawa, Toyama-ken (JP)

(73) Assignee: YKK Corporation (JP)

( * ) Notice: Subject to any disclaimer, the term of this patent is extended or adjusted under 35 U.S.C. 154(b) by 617 days.

(21) Appl. No.: 12/190,200

(22) Filed: Aug. 12, 2008

(65) Prior Publication Data

US 2009/0049659 A1 Feb. 26, 2009

(30) Foreign Application Priority Data

Aug. 20, 2007 (JP) ..... 2007-214012

(51) Int. Cl.
*A44B 19/26* (2006.01)

(52) U.S. Cl. ..... 24/415; 24/427; 24/432

(58) Field of Classification Search ..... 24/426, 24/415, 427, 428, 432
See application file for complete search history.

(56) References Cited

U.S. PATENT DOCUMENTS

| | | | | | |
|---|---|---|---|---|---|
| 2,568,163 | A * | 9/1951 | Morin | | 24/428 |
| 2,575,501 | A * | 11/1951 | Ulrich | | 24/404 |
| 2,721,367 | A | 10/1955 | Deshaw | | |
| 3,284,864 | A * | 11/1966 | Howell | | 24/424 |
| 4,071,928 | A * | 2/1978 | Oda | | 24/427 |
| 4,409,705 | A * | 10/1983 | Yuunaga | | 24/415 |
| 4,590,648 | A * | 5/1986 | Yoshida et al. | | 24/415 |
| 5,956,819 | A * | 9/1999 | Terasaki et al. | | 24/432 |
| D467,523 | S * | 12/2002 | Lin | | D11/221 |
| 6,497,016 | B1 * | 12/2002 | Lin | | 24/421 |
| 6,654,989 | B2 * | 12/2003 | Hamai | | 24/429 |
| D498,434 | S * | 11/2004 | Iwase | | D11/221 |
| 7,111,367 | B2 * | 9/2006 | Keyaki et al. | | 24/427 |
| 7,257,868 | B2 * | 8/2007 | Yoneshima | | 24/415 |
| 2003/0101548 | A1 | 6/2003 | Tang | | |
| 2005/0132541 | A1 * | 6/2005 | Yang | | 24/415 |

FOREIGN PATENT DOCUMENTS

| | | | |
|---|---|---|---|
| DE | 202007010028 | U1 | 10/2007 |
| EP | 1430804 | A1 | 6/2004 |
| JP | 50-25855 | | 8/1975 |

OTHER PUBLICATIONS

European Search Report, European Patent Application No. 08252681.5, mailed Jan. 13, 2011.

* cited by examiner

*Primary Examiner* — Robert J Sandy
*Assistant Examiner* — Rowland D Do
(74) *Attorney, Agent, or Firm* — Kilpatrick Townsend & Stockton LLP

(57) ABSTRACT

The present invention provides a slider for a concealed type slide fastener with a separable bottom end stop capable of restoring a status to a normal one when an insert pin is inserted with an abnormal status, wherein a recess is provided in a shoulder mouth of a lower blade sideways of a diamond erected from a body of the slider and a slope is formed on a side wall sideways of the diamond and a rear mouth side of the recess, and the slope of the side wall restores the fastener tape into a parallel condition quickly and after that, the insert pin can be inserted into a box, thereby attaching the bottom end stop smoothly and easily.

6 Claims, 12 Drawing Sheets

SLIDER FOR CONCEALED TYPE SLIDE FASTENER WITH SEPARABLE BOTTOM END STOP

BACKGROUND OF THE INVENTION

1. Field of the Invention

The present invention relates to a slider for a concealed type slide fastener for use in a separable bottom end stop constituted of a box, a box pin and an insert pin, which is attached to an end of a fastener chain in the concealed type slide fastener, the separable bottom end stop separating the fastener chain in a closed state to right and left fastener stringers when the slider is operated in the back and forth direction and closing the fastener chain in an open state, and more particularly to a slider for a concealed type slide fastener with a separable bottom end stop intended to improve the insertability of an insert pin to a slider.

2. Description of the Related Art

In a slider for a concealed type slide fastener with a separable bottom end stop conventionally known, as shown in FIGS. 11 and 12, a diamond 106 is erected in the longitudinal direction in the center of a lower blade 105 of a slider body and a tab attaching portion 107 having a locking mechanism is provided on the top of the diamond 106 although not shown in the drawings. This tab attaching portion 107 is stretched sideways of the diamond 106 and flanges 108 capable of pressing an inverted portion of fastener elements 123 are provided on both sides of the lower blade 105, to thereby form a Y-shaped guide portion through which the fastener elements 123 pass. An upper blade 109 is provided curvedly above the flanges 108 so as to oppose the bottom edge of the tab attaching portion 107 and a tape passage 119 through which the fastener tape can pass is provided between the tab attaching portion 107 and the upper blade 109, thereby completing the concealed type slider 101.

In a fastener chain for the concealed type slide fastener for use in this slider 101, the side edge of the fastener tape in the fastener chain is bent into a U shape in its cross section, and coupling heads of the fastener elements 123 are attached to the outside face of the bent tape such that the coupling heads are projected outward while a reinforcement tape is attached to a space portion in which no fastener elements 123 exist. The box 126 and box pin 127 of the separable bottom end stop which can separably close the fastener stringer 125 are attached on the reinforcement tape on one side so that the box 126 and box pin 127 are continuous to the fastener elements 123 while the insert pin which can be inserted into an insert pin insertion hole in the box 126 is attached on the fastener stringer 125 on the other side so that the insert pin 128 is continuous to the fastener elements 123. After this insert pin 128 is inserted into the insert pin insertion groove in the guide groove 111 of the slider 101 and the insert pin insertion hole in the box 126, the slider 101 is pulled upward and slid so as to close right and left fastener stringers 125, thereby completing the concealed type fastener chain.

Further, a slider with a separable bottom end stop shown in FIG. 13 has been known. In this concealed type slider, parallel portions are provided at a rear mouth of an upper blade 209 provided curvedly on the top of flanges 208 on both sides on a lower blade 209 of the body and then, a recess portion 220 is provided in the upper blade 209 from the vicinity of a shoulder mouth of the upper blade 209 to the parallel portion so as to reduce a contact face with a fastener tape. A tab attaching portion 207 having a locking mechanism is provided on the top of a diamond, and a guide flange is provided on the bottom edge thereof while blade pieces for assisting fastener elements to be arranged neatly are formed above the guide flanges. More specifically, the blade pieces make contact with the top face of the coupling heads of the fastener elements projecting from the fastener tape so as to prevent the fastener elements from moving upward. Further, a concealed type slider provided with an arrangement body for neatly arranging and guiding the coupling heads of the fastener elements at a front end on the rear mouth side of the diamond has been described in Japanese Patent Publication No. 50-25855. In the meantime, as a fastener chain for use, the same one as the above-described fastener chain can be used.

In the concealed type sliders 101 shown in FIGS. 11 and 12 and 13, the inner faces of the lower blades 105, 205 on both sides of the diamond 106 on the lower blade 105, 205 of the body have not been improved in any way. When the insert pin 128 attached to the fastener stringer 125 is inserted from the shoulder mouth of the slider 101, the insert pin 128 tends to rotate around a folded point so that the insert pin 128 droops with respect to the fastener tape surface, that is, tilts substantially at right angle, because the side edge of the fastener tape is folded into the U shape and the insert pin 128 is attached to a side end with respect to the folded portion. Further, the surface on the fastener element coupling head side of the insert pin 128 itself is folded and curved slightly around the center in the longitudinal direction and a side thereof connected to the fastener element 125 is formed thickly. Thus, if the insert pin 128 is inserted from the shoulder mouth of the slider 101 in a drooping state, the front end facing downward of the insert pin 128 comes into contact with the lower blade 105, 205 of the slider 101 while a curved portion on the top of the insert pin 128 comes into contact with a guide flange formed on the top of the diamond 106 or the upper blade 109, 209, so that the coupling head of the fastener element 123 adjoining the insert pin 128 is caught by that portion and consequently, the bottom end stop cannot be attached smoothly.

SUMMARY OF THE INVENTION

The present invention has been achieved in views of the above-described problems and a first object of the invention is to provide a slider for a concealed type slide fastener with a separable bottom end stop which, even if an insert pin attached on a fastener stringer is inserted into an insert pin insertion groove of the slider on the inner face of a lower blade of a body of the slider for the concealed type slide fastener not in a normal status with respect to the fastener tape face but such that the insert pin is drooped or tilted with respect to the fastener face to some extent, restores the insert pin to a normal status by means of a mechanism for restoring the status of the insert pin, provided on the inner face of the lower blade of the slider. The normal status or normal position of the insert pin mentioned herein refers to a condition that the insert pin is disposed in parallel to the fastener tape face while the lateral sectional shape of the side edge of the fastener tape on which the insert pin is attached presents a U shape so that the insert pin can be inserted directly into the insert pin insertion hole in the box. Accordingly, this prominent object of the present invention is to provide a slider for a concealed type slide fastener with a separable bottom end stop which allows an insert pin in the normal status or at the normal position to be inserted smoothly and easily into a slider and a box.

A second object of the present invention is to provide the slider for a concealed type slide fastener with a separable bottom end stop, which allows the insert pin to be inserted into the slider and the box smoothly by finishing a recess which serves as a mechanism for restoring the insert pin to the normal position, provided on the inner face of a lower blade of a body of the slider, such that a wall face on a diamond side and a wall face on a rear mouth side are of slope.

A third object of the present invention is to provide the slider for a concealed type slide fastener with a separable bottom end stop, which allows right and left fastener stringers to be coupled ideally and rapidly in an optimum position by limiting an arrangement range of the recess which serves as the mechanism for restoring the insert pin to the normal position, provided on the inner face of the lower blade of the body of the slider.

A fourth object of the present invention is to provide the slider for a concealed type slide fastener with a separable bottom end stop, in which the recess which serves as the mechanism for restoring the insert pin to the normal position, provided on the inner face of the lower blade of the body of the slider, allows a fastener stringer with the insert pin to be conveyed smoothly so as to couple the fastener stringer with a fastener stringer on the box pin side accurately.

A fifth object of the present invention is to provide the slider for a concealed type slide fastener with a separable bottom end stop, in which the recess which serves as the mechanism for restoring the insert pin to the normal position, provided on the inner face of the lower blade of the body of the slider, allows the inert pin to be restored to the normal position quickly, the fastener stringers to be conveyed to the rear mouth of the slider smoothly in the normal condition and the fastener stringers to be coupled with each other accurately.

A sixth object of the present invention is to provide the slider for a concealed type slide fastener with a separable bottom end stop, in which the recesses which serve as the mechanism for restoring the insert pin are provided on both sides of the diamond on the inner face of the lower blade of the body of the slider so that this slider can be immediately used in both countries or areas adopting a right side insertion system and countries or areas adopting a left side insertion system because countries in the world do not adopt the same system for separable bottom end stop operation in slide fastener, so as to intensify the convenience of the slider.

To achieve the above-described objects, according to a first aspect of the present invention, there is provided a slider for a concealed type slide fastener, in which opposite side edge portions of fastener tapes of the concealed type slide fastener are folded into a U shape and fastener elements are attached along the outside surface of the side edge portion such that coupling heads are projected so as to construct a pair of fastener stringers, so that the coupling heads of the fastener elements attached on the fastener tape are engaged or disengaged. In such a slider for a concealed type slide fastener with a separable bottom end stop, there is provided a recess which can restore an insert pin to a normal position even if the insert pin inserted from an end portion of a shoulder mouth of a guide groove, through which the fastener stringer having the insert pin is inserted, of Y-shaped guide grooves for guiding the fastener elements, provided sideways of a diamond on the inner face of a lower blade of a body of the slider, is not located at the normal position, that is, the insert pin is drooped or tilted with respect to the face of the fastener tape.

According to a second aspect of the invention, there is provided the slider for a concealed type slide fastener with a separable bottom end stop according to the first aspect, wherein the recess for restoring the insert pin to the normal position, provided concavely in the lower blade of the body of the slider, is configured to accelerate the restoration of the insert pin by forming a side wall on the diamond side and a side wall on the rear mouth side into a slope having an inclination.

According to a third aspect of the invention, there is provided the slider for a concealed type slide fastener with a separable bottom end stop according to the first aspect, wherein the recess for restoring the insert pin to the normal position, provided concavely in the lower blade of the body of the slider, is provided concavely within a range sideways of the diamond on the body.

According to a fourth aspect of the invention, there is provided the slider for a concealed type slide fastener with a separable bottom end stop according to the first aspect, wherein the recess for restoring the insert pin to the normal position, provided concavely in the lower blade of the body of the slider, is formed such that the width thereof is decreased gradually from the shoulder mouth of the body toward the rear mouth side.

According to a fifth aspect of the invention, there is provided the slider for a concealed type slide fastener with a separable bottom end stop according to the first aspect, wherein the recess for restoring the insert pin to the normal position, provided concavely in the lower blade of the body of the slider, is provided between an intermediate partition which is located sideways of the diamond on the shoulder mouth side of the body and on which the coupling head of the fastener element can be placed and a proximal portion located at a corner of the flange so as to support and press an inverted portion of the fastener element.

According to the sixth aspect of the invention, there is provided the slider for a concealed type slide fastener with a separable bottom end stop according to the first aspect, wherein the recesses for restoring the insert pin to the normal position, provided concavely in the lower blade of the body of the slider, are provided in the Y-shaped guide grooves provided on both sides of the diamond such that the recesses are extended from both the shoulder mouths to the rear mouth, so that the fastener stringers having the insert pin can be adopted for both right side insertion and left side insertion, so as to cope with a right side insertion system and a left side insertion system of the insert pin found in countries and areas of the world.

According to the first aspect of the present invention, there is provided a slider for a concealed type slide fastener with a separable bottom end stop for engaging/disengaging coupling heads of a pair of fastener stringers in which opposite side edge portions of fastener tapes are bent into a U shape and fastener elements are mounted along the outside surface of the side edge portion, wherein a recess is provided concavely in a Y-shaped guide groove provided in the inner face of a lower blade such that the recess is extended from an end portion of a shoulder mouth toward a rear mouth side, thereby achieving the following effect.

The recess for restoring the insert pin inserted to the shoulder mouth side of the insert pin insertion groove on one side of the guide grooves to the normal position is provided in the inner face of the lower blade of the body of the slider. With this configuration, even if the insert pin rotates in a vertical direction with respect to the fastener tape face so that the insert pin is in an irregular condition, for example, drooped or tilted, the top face of the insert pin comes into contact with the bottom face of the tab attaching portion of the diamond while the bottom face of the front end of the insert pin comes into contact with the recess provided in the lower blade. Consequently, the insert pin can be inserted at ease, so that the insert pin is never sandwiched between upper and lower faces or blocked from being inserted unlike conventionally, thereby smoothly inserting the insert pin.

According to the second aspect of the invention, a side wall on the diamond side and a side wall on the rear mouth side of the recess are formed of a slope. Consequently, in addition to the effect of the first aspect, in the recess for restoring the insert pin to the normal position, the wall faces of the side walls on the diamond side and the rear mouth side thereof are formed into the slope so as to quickly and smoothly restore the drooped or tilted insert pin rotated in the vertical direction, to the normal condition.

According to the third aspect of the invention, the recess is provided within a range sideways of the diamond. Consequently, in addition to the effect of the first aspect, right and left fastener elements can be coupled accurately and securely by the intermediate partition disposed between the diamond and the rear mouth because the recess for restoring the insert pin to the normal position is provided sideways of the diamond.

According to the fourth aspect of the invention, the recess is formed such that the width thereof is decreased gradually from the shoulder mouth toward the rear mouth side. Consequently, in addition to the effect of the first aspect, the insert pin in an abnormal condition can be restored to the normal position quickly so as to feed the fastener stringers securely because the recess for restoring the insert pin to the normal condition is formed so that the width thereof is decreased gradually from the shoulder mouth to the rear mouth side.

According to the fifth aspect of the invention, the recess provided sideways of the diamond is formed concavely between an intermediate partition provided sideways of the diamond on the shoulder mouth side and a proximal portion of the corner of the flange. Consequently, in addition to the effect of the first aspect, the insert pin is restored to the normal position, so that the coupling head of the fastener element connected to the insert pin is placed on the intermediate partition quickly and an inverted portion of the fastener element is placed on the proximal portion and pressed by the flange. As a result, the fastener stringers can be conveyed securely and coupled with each other smoothly.

According to the sixth aspect of the present invention, the recesses are provided in the lower blade on both sides of the diamond so as to be able to cope with right side insertion and left side insertion of the insert pin. Consequently, in addition to the effect of the first aspect, this slider can cope with the right side insertion and left side insertion of the insert pin, so that the slider is applicable in any countries and areas of the world quickly. Therefore, the effects which the present invention can achieve are considerable.

DESCRIPTION OF THE PREFERRED EMBODIMENTS

Figure 1:
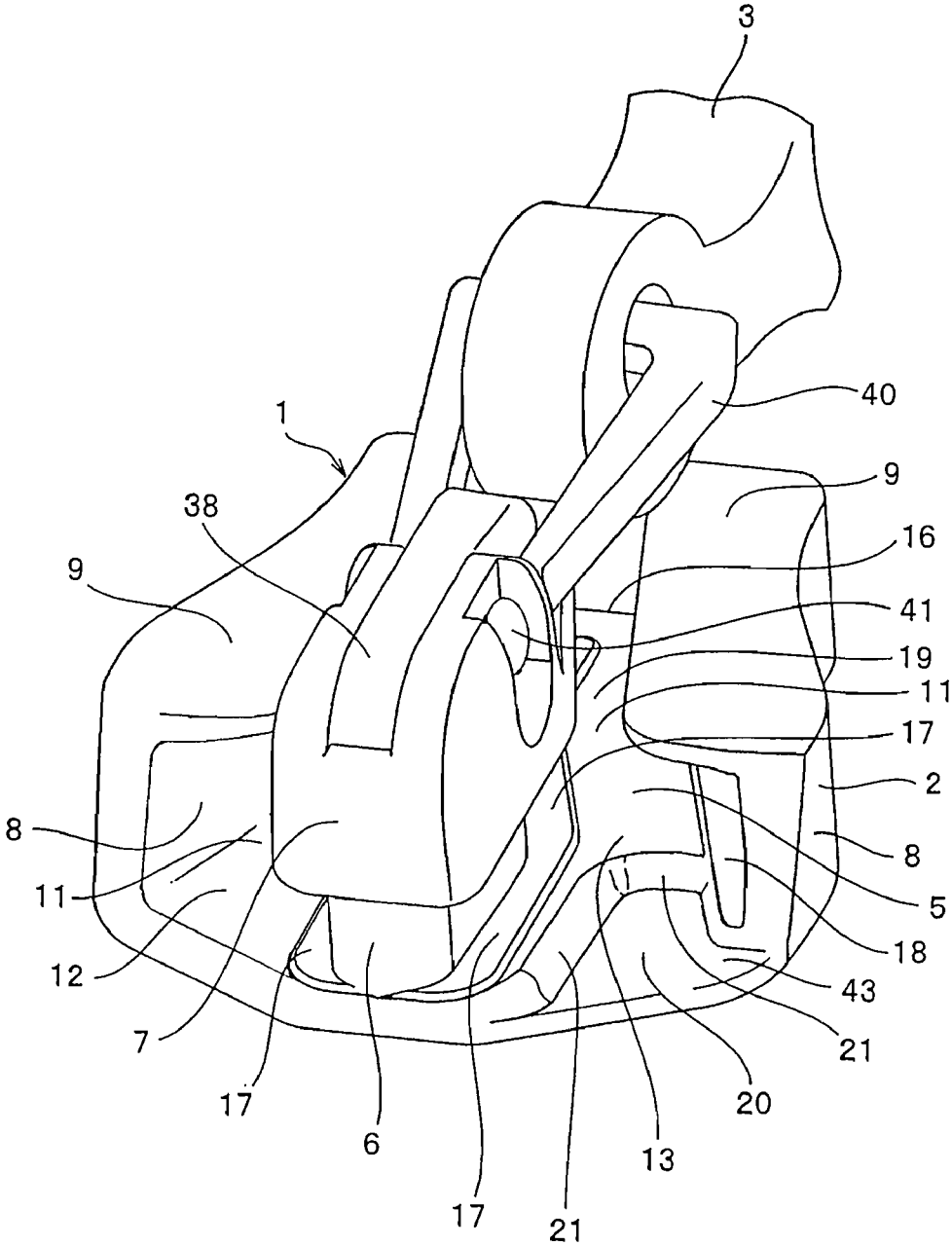
FIG. 1 is a perspective view of a slider for a concealed type slide fastener according to a first embodiment.

In a slider for a concealed type slide fastener with a separable bottom end stop of the present invention, preferably, a body 2 of a slider 1 and a separable bottom end stop 4 constituted of individual box 26, box pin 27 and insert pin 28 are all made of metal. In a concealed type fastener stringer 25 with a separable bottom end stop through which the slider 1 is inserted, fastener elements 23 are attached along opposite side edges of a pair of fastener tapes with coupling heads 31 set inside by sewing or the like. A reinforcement tape 30 is bonded to a space portion 29 of the fastener tape 22 in which no fastener element 23 exists, at an end of the pair of fastener stringers 25 and a box pin 27 is attached on the side edge of the space portion 29 of the fastener stringer 25 on one side while an insert pin 28 is attached on the side edge of the space portion 29 of the other fastener stringer 25. Further, a box 26 is attached to a front end of the box pin 27 and the box 26 is formed on a side opposite to the box pin 27 so that the insert pin 28 can be inserted therein. An attachment edge portion 42 of each of the pair of fastener stringers 25, on which the fastener elements 23 are attached, is bent into a U shape along continuous elements 35 such that the coupling heads 31 of the fastener elements 23 are projected outward and then, this portion is fixed by thermal setting.

In the slider 1 for the concealed type slide fastener, as shown in the perspective view of FIG. 1, a diamond 6 is erected in the center of a shoulder mouth 15 of a lower blade 5 and a tab attaching portion 7 for attaching a tab 3 is provided on the top portion of the diamond 6. This tab attaching portion 7 is stretched sideways wider than the width of the diamond 6 and the tab attaching portion 7 is extended to the rear mouth 16 side and a pawl lever 38 as a locking mechanism is mounted thereon. The tab 3 is attached to the pawl lever 38 through a connection ring 40. An end portion of the tab attaching portion 7 on the rear mouth 16 side guides the top faces of the coupling heads 31 of continuous elements 35 in a fastener chain for the concealed type slide fastener in order to prevent the fastener chain from slipping out of a guide groove 11 of the slider 1.

Flanges 8 are provided on both sides of the lower blade 5 so as to make a firm contact with an inverted portion 32 side of the fastener element 23 for guide and an upper blade 9 curved toward the diamond 6 is provided on the top portion of the flange 8. The upper blade 9 is formed so as to be able to make a firm contact with leg portions 33 of the fastener element 23 and the side edge of the fastener tape 22 on which the leg portions 33 are attached from above. Then, a tape passage portion 19 which allows the fastener tape 22 to pass therethrough is formed between the diamond 6 and the upper blade 9 at a front end opposing the diamond 6 of the upper blade 9 and the portion bent into the U shape of the fastener tape 22 is passed through the tape passage portion 19.

Figure 4:
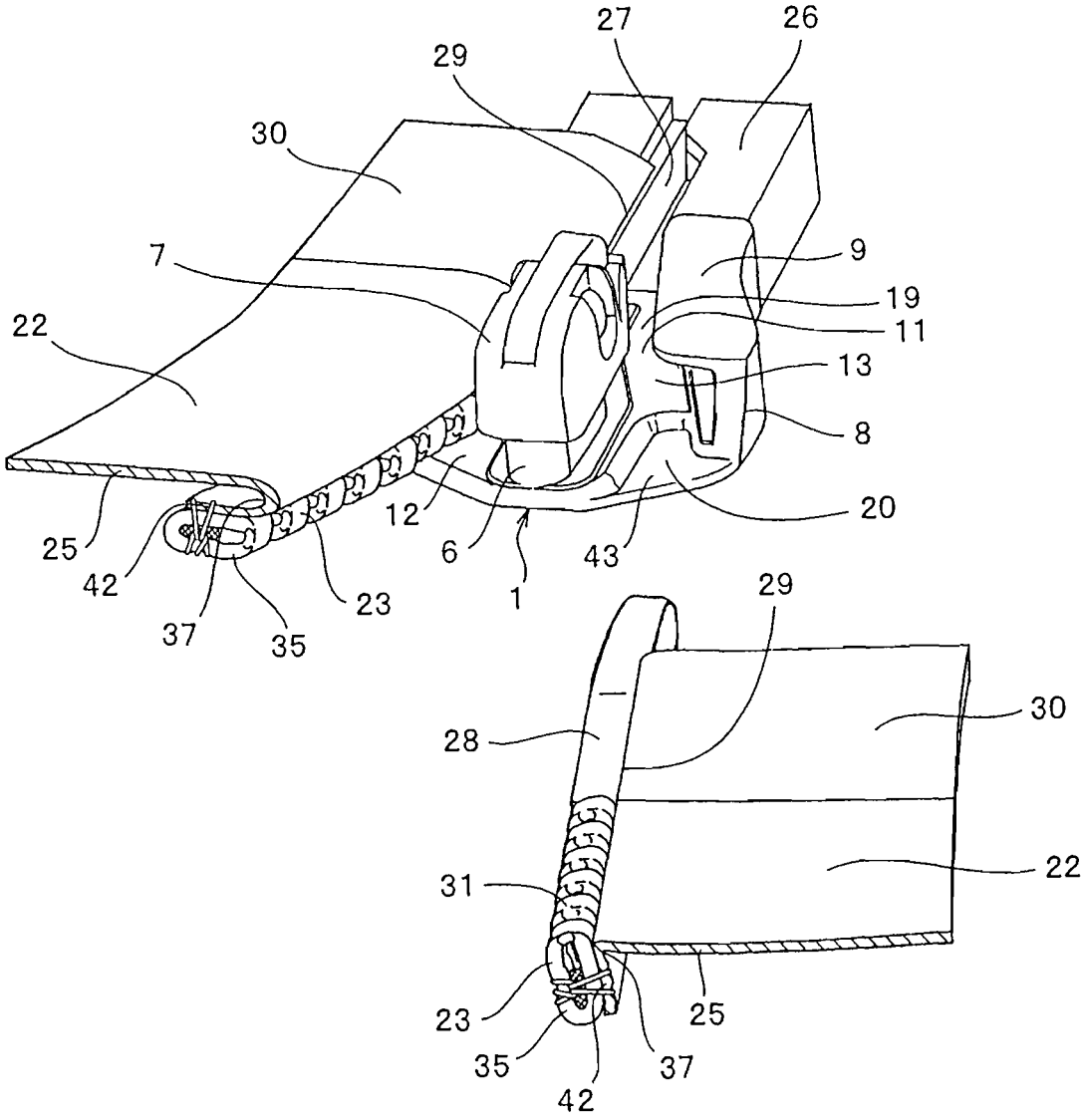
FIG. 4 is a perspective view showing a usage condition of the slider.

The Y-shaped guide groove 11 formed on both sides of the diamond 6 has a box pin insertion groove 12 on one side and an insert pin insertion groove 13 on the other side. Assume that the insert pin 28 attached to the fastener tape 22 is not disposed in a normal condition, that is, in parallel to the fastener tape 22 face on the inner face of the shoulder mouth 15 of the lower blade 5 in the insert pin insertion groove 13 so that the insert pin can hardly be inserted into the slider 1 easily. In this case, when as shown in FIG. 4, the side edge portion 37 of the fastener tape 22 is held at right angle without being kept in the U shape and the insert pin 28 is inserted in a vertical state, that is, in a drooping state or in a tilted state with respect to the fastener tape 22 face, the mechanism formed by the present invention restores this state into a normal state, that is, so that the insert pin 28 is disposed in parallel to the fastener tape 22 face, for example, a recess 20 is formed in the inner face of the lower blade 5 such that the recess 20 extends from an end portion of the shoulder mouth 15 side to the rear mouth 16. Thus, a bottom face 43 which is lower than the inner face of the lower blade 5 is formed. Further, the recess 20 has a side wall 21 which connects the inner face of the lower blade 5 with the bottom face 43. The side wall 21 on the diamond 6 side and the side wall 21 on the rear mouth 16 side provide a slope.

In the fastener chain for the concealed type slide fastener, the slider 1 is fixed to the fastener stringers 25 on which the box pin 27 and the box 26 are attached such that the slider 1 adjoins the box 26, and the insert pin 28 of the fastener stringer 25 and the U-shaped folded portion of the fastener tape 22, that is, the side edge portion 37 are inserted into the tape passage portion 19 of the slider 1. Even if the insert pin 28 is inserted in the drooping state or the tilted state, an element attaching edge portion 44 on which the insert pin 28 is attached is corrected to a parallel condition to the fastener tape 22 face rapidly and the front end of the insert pin 28 is advanced smoothly along the side wall 21 on the rear mouth 16 side of the recess 20. If the slider 1 is pulled upward after the insert pin 28 is inserted into an insert pin insertion hole 34 in the box 26, the coupling heads 31 of the right and left fastener element 23 are pressed by the top face of an intermediate partition 17 provided on the rear mouth 16 side of the diamond 6 while the inverted portion 32 of the fastener element 23 is pressed by the flanges 8 provided on both sides of the lower blade 5, so that right and left coupling heads 31 are coupled successively so as to complete the concealed type slide fastener chain.

To cope with right side insertion or left side insertion of the insert pin 28, it is permissible to concavely provide the recess 20 on each of the right and left insertion grooves 12, 13 in the Y-shaped guide groove 11 of the lower blade 5 having the erected diamond 6, so as to construct the slider 1 which can cope with the right side insertion and left side insertion of the insert pin 28.

First Embodiment

In a slider for a concealed type slide fastener with a separable bottom end stop of a first embodiment shown in FIG. 1 to FIG. 7, a body of the slider 1 and a separable bottom end stop 4 constituted of individual box 26, box pin 27 and insert pin 28 are formed of metal such as aluminum alloy and zinc alloy. In a concealed type fastener stringer 25 through which the slider 1 is passed, fastener elements 23 are attached along opposite side edges of a pair of fastener tapes 22 with coupling heads 31 set inside by sewing or the like. A space portion 29 of the fastener tape 22 in which no fastener element 23 exists is provided at an end of the pair of fastener stringers 25 and a reinforcement tape 30 is bonded to its surface. The substantially prismatic box pin 27 is attached adjacent the fastener elements 23 on the side edge of the space portion 29 of one fastener stringer 25 while the insert pin 28 is attached on the side edge of the space portion 29 of the other fastener stringer 25.

The insert pin 28 adjoins the fastener element 23 attached on the side edge of the other fastener stringer 25 and presents a substantially prismatic configuration having a top face, a bottom face and a side face connecting the top face and the bottom face. The half corner on the front end side in the longitudinal direction of the insert pin 28 is cut out in an inclined shape.

In the meantime, the top and bottom faces of the insert pin 28 refer to faces corresponding to the front and rear surfaces of the fastener tape 22 and the side face refers to a face perpendicular to the top and bottom faces. Further, the box 26 is attached to the front end of the box pin 27 slightly movably and the insert pin 28 can be inserted into a position adjacent to the portion of the box 26 on which the box pin 27 is attached. The attaching edge portion 42, on which the fastener elements are attached, of each of the pair of fastener stringers 25 obtained in this way is bent into the U shape along the continuous elements 35 such that the coupling heads 31 of the fastener elements are projected outward, and fixed by thermal setting so that the bent state is never changed.

Figure 2:
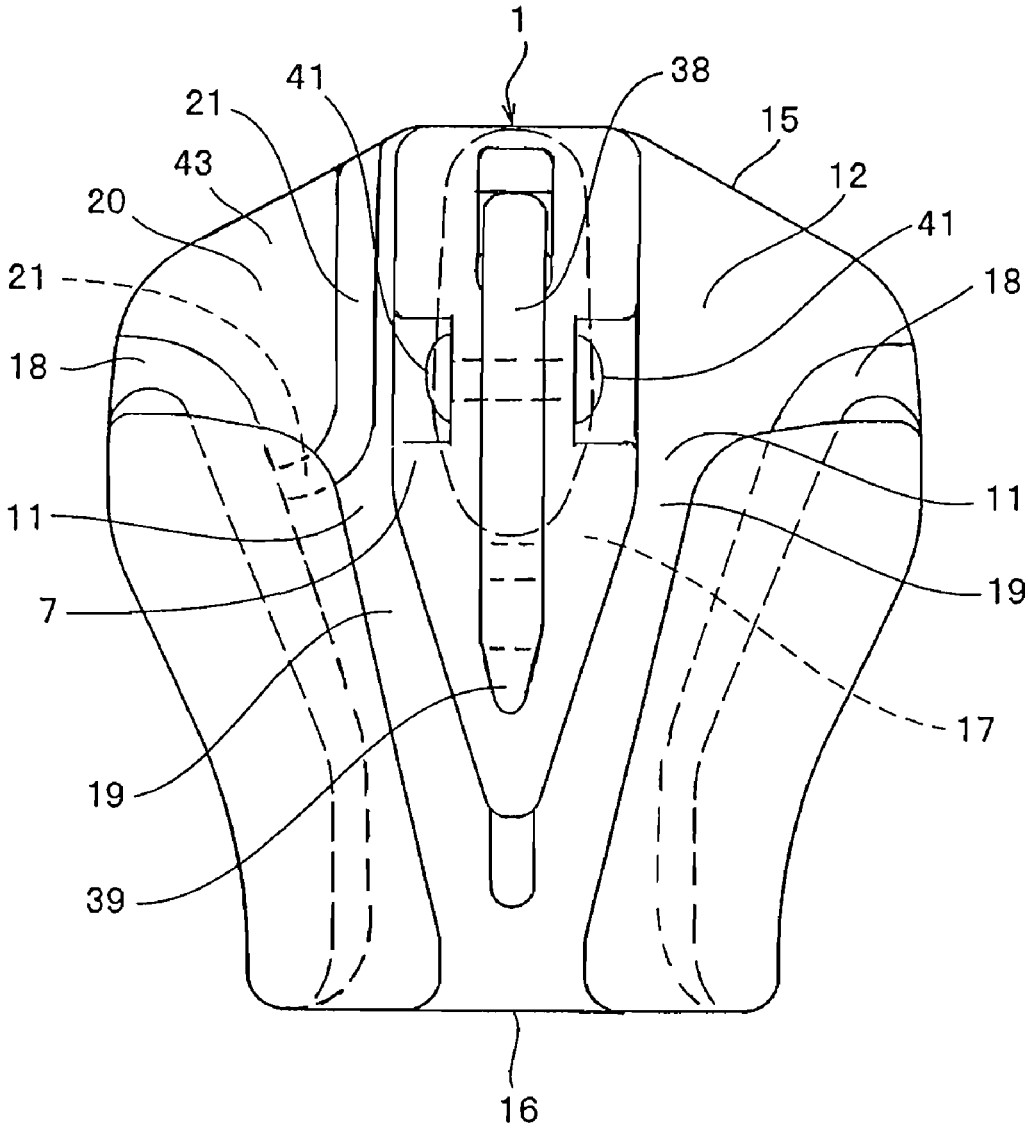
FIG. 2 is a plan view of the slider.
Figure 3:
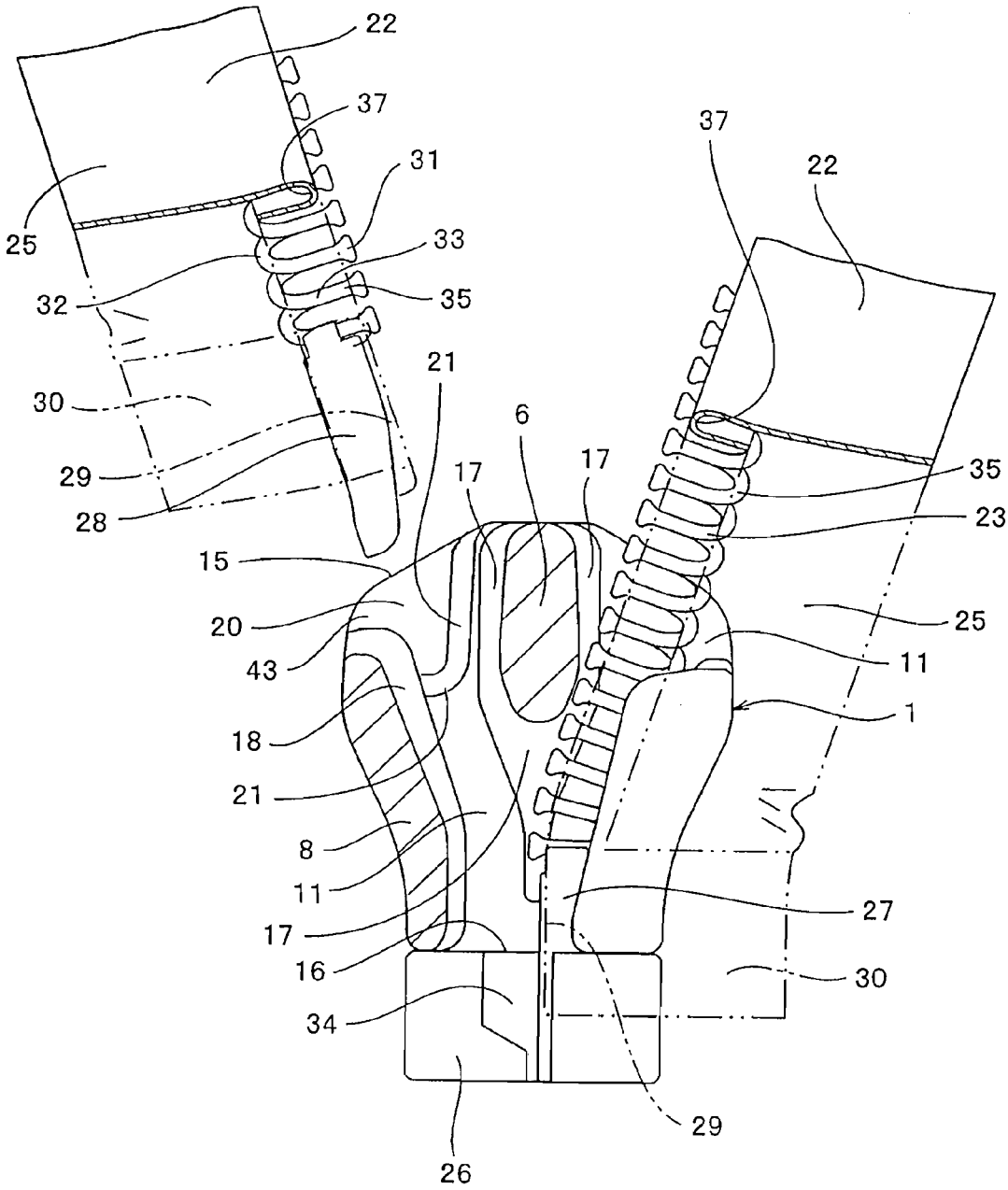
FIG. 3 is a plan view showing a usage condition of the slider.

In the slider 1, as shown in FIG. 1 and FIG. 2, a diamond 6 is erected in the center of an end in the sliding direction of the slider 1 in a lower blade 5 of the body 2 and a tab attaching portion 7 for attaching a tab 3 is provided on the top portion of the diamond 6. This tab attaching portion 7 is formed integrally such that it is extended outward from the periphery of the diamond 6 and the tab attaching portion 7 is extended to the other end in the sliding direction of the slider 1 and then, a pawl lever 38 having a locking pawl 39 as a locking mechanism is attached thereon through a rivet 41. The tab attaching portion 7 presents substantially the same shape as an intermediate partition 17 formed on the inner face of the lower blade 5 and the bottom edge of the tab attaching portion 7 can press and guide the top face of the coupling heads 31 of the continuous elements 35 formed of resin filament in the concealed type fastener chain in order to prevent the concealed type fastener chain passed through the Y-shaped guide groove 11 surrounded by the lower blade 5, diamond 6, tab attaching portion 7, flanges 8 and upper blade 9 formed inside the slider 1 from slipping out.

Flanges 8 are erected on right and left side edge portions of the inner face of the lower blade 5 perpendicular to the sliding direction of the slider 1 so that the flanges 8 can make a firm contact with the inverted portions 32 of the fastener elements 23 and an upper blade 9 is provided on the top portion of the flange 8 such that the upper blade 9 is projected toward the diamond 6. The upper blade 9 is provided to make a firm contact with leg portions 33 of the fastener element 23 and the side edge of the fastener tape 22 on which the leg portions 33 are attached so as to guide the fastener tape 22. A tape passage portion 19 through which the fastener tape 22 can pass is formed between the diamond 6 and the upper blade 9 at a front end of the upper blade 9 opposing the diamond 6 and the side edge portion 37 bent into the U shape of the fastener tape 22 is passed through the tape passage portion 19.

A recess 20 for restoring the fastener tape 22 into the normal position in which the fastener tape 22 is bent into the U shape is provided concavely on the shoulder mouth 15 side in which the insert pin 28 is to be inserted, of the inner face of the lower blade 5 of the slider 1, in order to displace the insertion direction or the insertion axis of the insert pin from the end portion of the shoulder mouth 15 toward the rear mouth 16 side. This recess 20 has a bottom face 43 which is lower than the inner face of the lower blade 5 of the rear mouth 16 side. The bottom face 43 of the recess 20 is connected with the inner face of the lower blade 5 with a mild slope for a smooth operation of restoring the inserted insert pin 28 into the normal position. Further, this slope is constituted of a side wall 21 provided sideways the diamond 6 formed in parallel to the sliding direction of the slider 1 and a side wall 21 located on the rear mouth 16 side, disposed on a proximal portion 18 of the flange 8. In the meantime, the shoulder mouth 15 side of the recess 20 is formed of a flat face which is open outside to facilitate insertion of the insert pin 28.

Preferably, the recess 20 is formed within a range sideways of the diamond 6, that is, within a range perpendicular to an end portion on the rear mouth 16 side of the diamond 6 in the inner face of the lower blade 5. If the recess 20 is formed within this range, the inserted insert pin 28 can be restored to a substantially normal position before right and left fastener elements 23 are coupled with each other, so that such a phenomenon that the insert pin 28 is nipped between the inner face of the lower blade 5 and the bottom edge of the tab attaching post 7, thereby disabling the insert pin 28 from being inserted is never generated. Further, the recess 20 is provided concavely between the intermediate partition 17 provided sideways of the diamond 6 and the proximal portion 18 of the corner portion of the flange 8 on the shoulder mouth 15 side, and the side wall 21 sideways of the diamond 6 is formed substantially in the center on the shoulder mouth 15 side with a predetermined gap with respect to the diamond 6. The side wall 21 sideways of the diamond 6 is formed in parallel to the sliding direction of the slider 1 and the flanges 8 are provided along the intermediate partition 17 provided on the body 2 in order to press the inverted portions 32 of the fastener elements 23. Thus, the recess 20 provided concavely between the diamond 6 and the flange 8 needs to be formed so that the width thereof is decreased gradually from the shoulder mouth 15 toward the rear mouth 16. With such a structure, the insertion angle of the insert pin 28 to the slider 1 can be optimized, so that the insert pin 28 can be restored to the normal position easily.

Next, an action of the insert pin 28 to be restored to the normal position as shown in FIG. 4 to FIG. 7 will be described.

Figure 5:
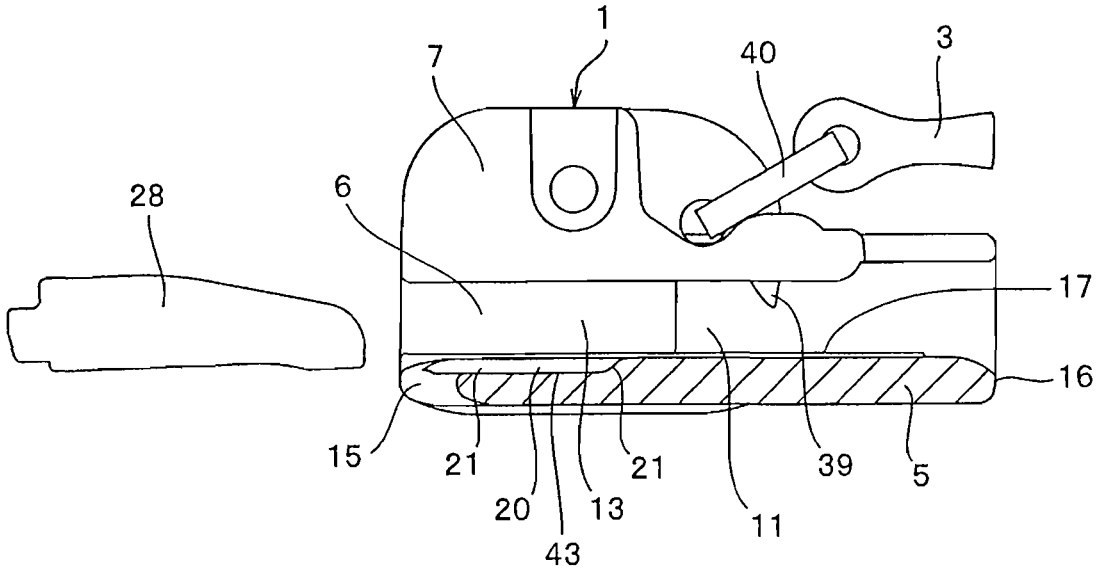
FIG. 5 is a partially cut-out side view showing a usage condition of the slider.
Figure 6:
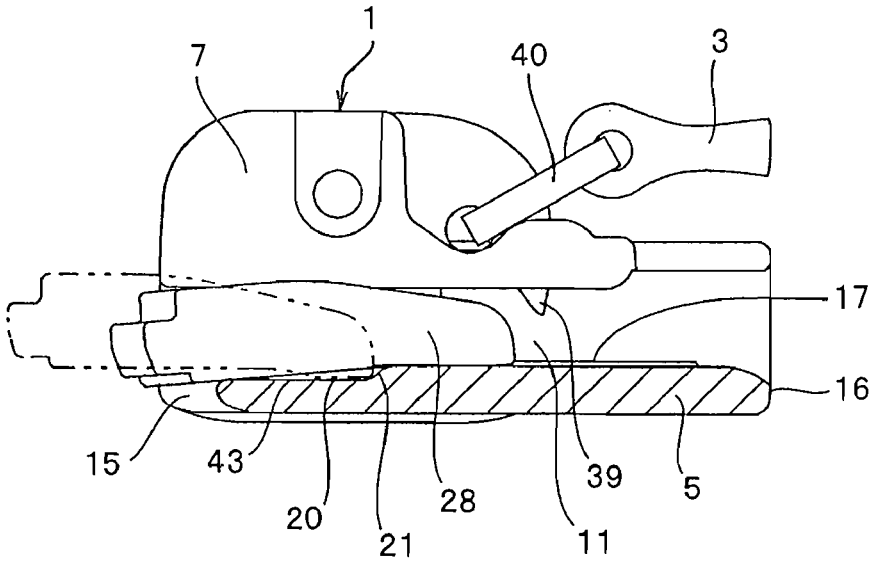
FIG. 6 is a partially cut-out side view showing a usage condition of the slider.
Figure 7:
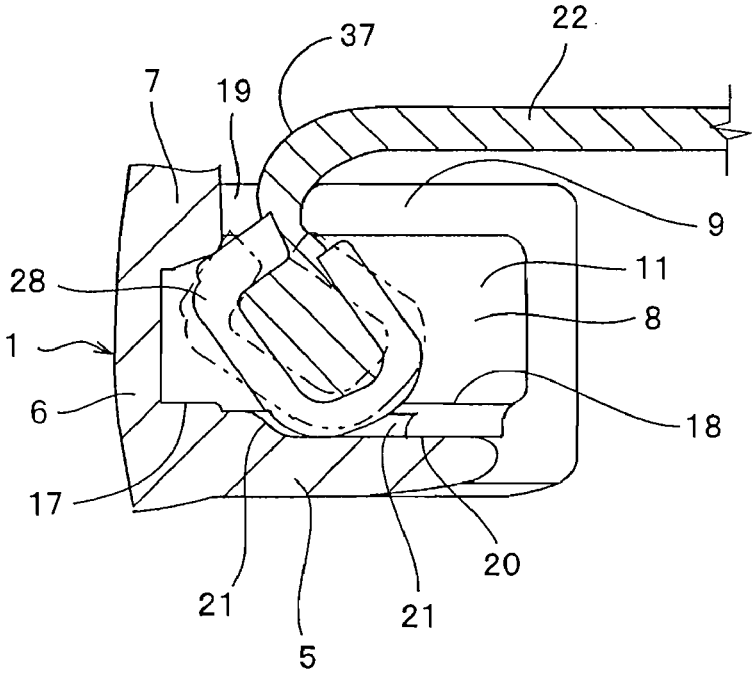
FIG. 7 is a partially cut-out enlarged view showing a usage condition of the slider.

In the entirely Y-shaped guide groove 11 formed on both sides of the diamond 6, a box pin insertion groove 12 is provided in one shoulder mouth 15 of the pair of shoulder mouths 15 and an insert pin insertion groove 13 is provided in the other shoulder mouth 15. Assume that the insert pin 28 attached on the fastener tape 22 is not disposed in a normal condition on the inner face of the shoulder mouth 15 side on the lower blade 5 in the insert pin insertion groove 13, that is, not disposed in parallel to the fastener tape 22 face so that the slider 1 can hardly be inserted easily. In this case, when as shown in FIG. 4, the fastener tape 22 is held at right angle without being kept in the U shape and the insert pin 28 is inserted in a vertical state, that is, in a drooping state or in a tilted state with respect to the fastener element 23, the mechanism formed by the present invention restores this state into a normal state, that is, so that the attaching edge portion 42 on which the fastener elements 23 are attached is bent into the U shape with respect to the fastener tape 22 face such that the top and bottom faces of the insert pin 28 become into an identical plane to the front and rear faces of the fastener tape 22. For example, the recess 20 is formed to correct the insertion state of the insert pin 28 so that the insert pin can be inserted into the insert pin insertion hole 34 in the box 26 in a normal state. Assume that the insert pin 28 is inserted into the slider 1 in a vertical state as shown in FIG. 5. In this case, if the insert pin 28 indicated with the phantom line is inserted deeper as shown in FIG. 6, the front end of the insert pin 28 comes into contact with the side wall 21 on the rear mouth 16 side and then, rides over the lower blade 5 as indicated with the solid line. On the other hand, the proximal end side of the insert pin 28 is dropped in the recess 20. If the insert pin is inserted deeper into the slider 1 from this state, a force of restoring the fastener tape 22 into an original state of being folded into the U shape is applied, so that as shown with the solid line, the insert pin 28 indicated with the solid line rotates to a position indicated with the phantom line as shown in FIG. 7. At this time, the recess 20 has a sufficient gap for the insert pin 28 to rotate to the original position because the recess 20 is formed lower than the inner face of the lower blade 5.

In the state shown in FIG. 7, the side wall 21 sideways of the diamond 6 formed along the sliding direction of the slider 1 is extended in a direction perpendicular to the insertion direction of the insert pin 28. Thus, when part of the insert pin 28 is inserted while making contact with the side wall 21 sideways of the diamond 6, the insert pin 28 is helped to be restored into the normal state. Further, the side wall 21 sideways of the diamond 6 is formed on the flange 8 side with respect to the tab attaching portion 7 as shown in FIG. 7. With this configuration, when the insert pin 28 is inserted with its side face making contact with the bottom edge of the tab attaching portion 7, the insert pin 28 is helped to be restored into the normal state.

In the concealed type fastener chain, the slider 1 is fixed to the fastener stringer 25 provided with the box pin 27 and the box 26 slightly movably and then, the insert pin 28 of the fastener stringer 25 provided with the insert pin 28 and the U-shaped folded portion of the fastener tape 22 are inserted into the tape passage portion 19 of the slider 1. Even if the insert pin 28 is inserted in the vertical state, there is secured a gap for the insert pin 28 to be restored into a parallel state to the fastener tape 22 face by the recess 20 provided concavely in the lower blade 5 of the slider 1, and the side wall 21 helps the insert pin 28 to be returned to its original position. Consequently, the side edge portion 37 of the fastener tape 22 is restored to the U-shaped condition and when the slider 1 is pulled upward after the insert pin is inserted into the insert pin insertion hole 34 in the box 26, the coupling heads 31 of the right and left fastener elements 23 are pressed by the top face of the intermediate partition 17 provided on the rear mouth 16 side of the diamond 6 while the inverted portions 32 of the fastener elements 23 are pressed inward by the flanges 8 provided curvedly on both sides of the lower blade 5. Thus, right and left coupling heads 31 are coupled with each other successively so as to complete the fastener chain for the concealed type slide fastener.

Second Embodiment

Figure 8:
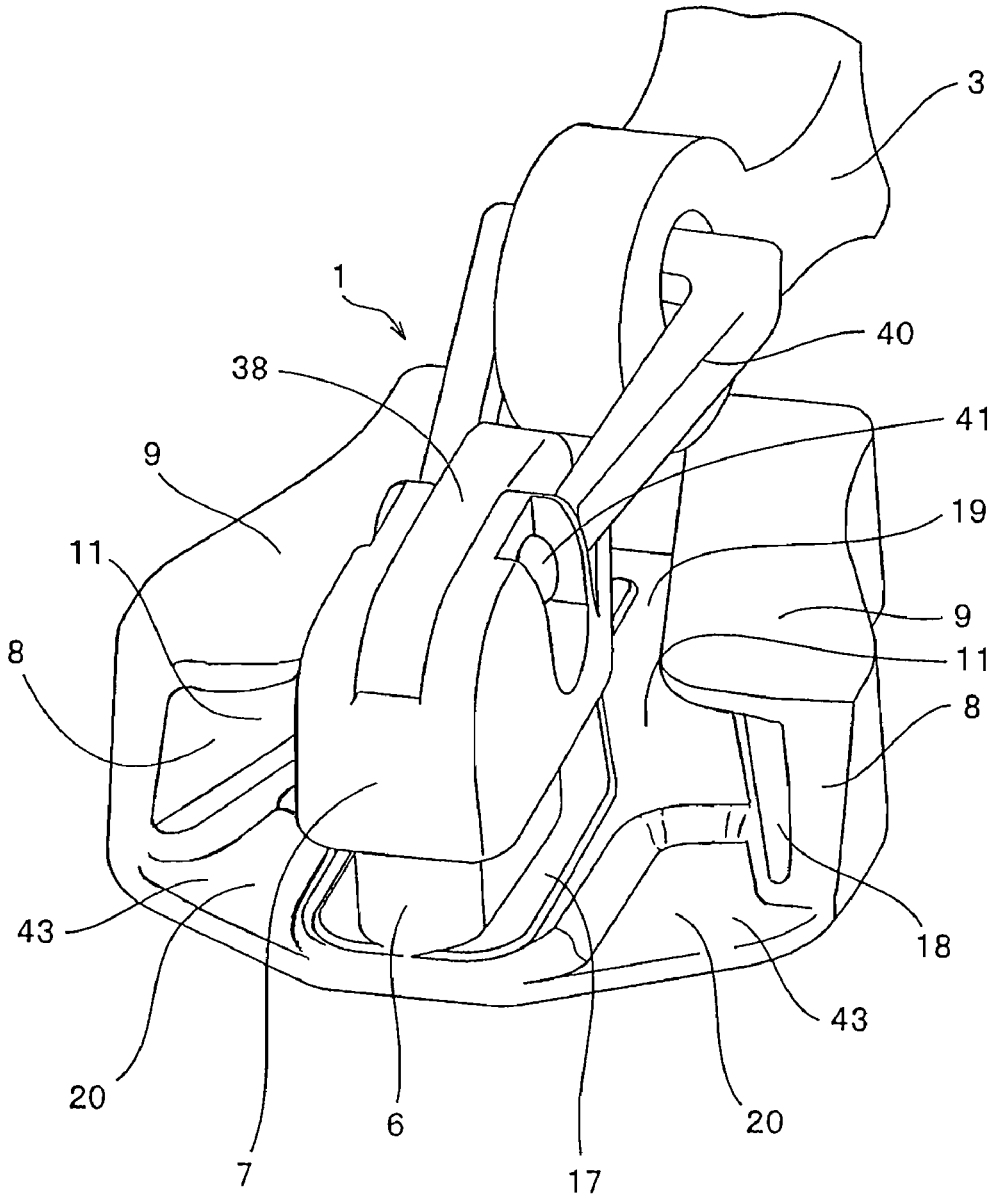
FIG. 8 is a perspective view of a slider for a concealed type slide fastener according to a second embodiment.
Figure 9:
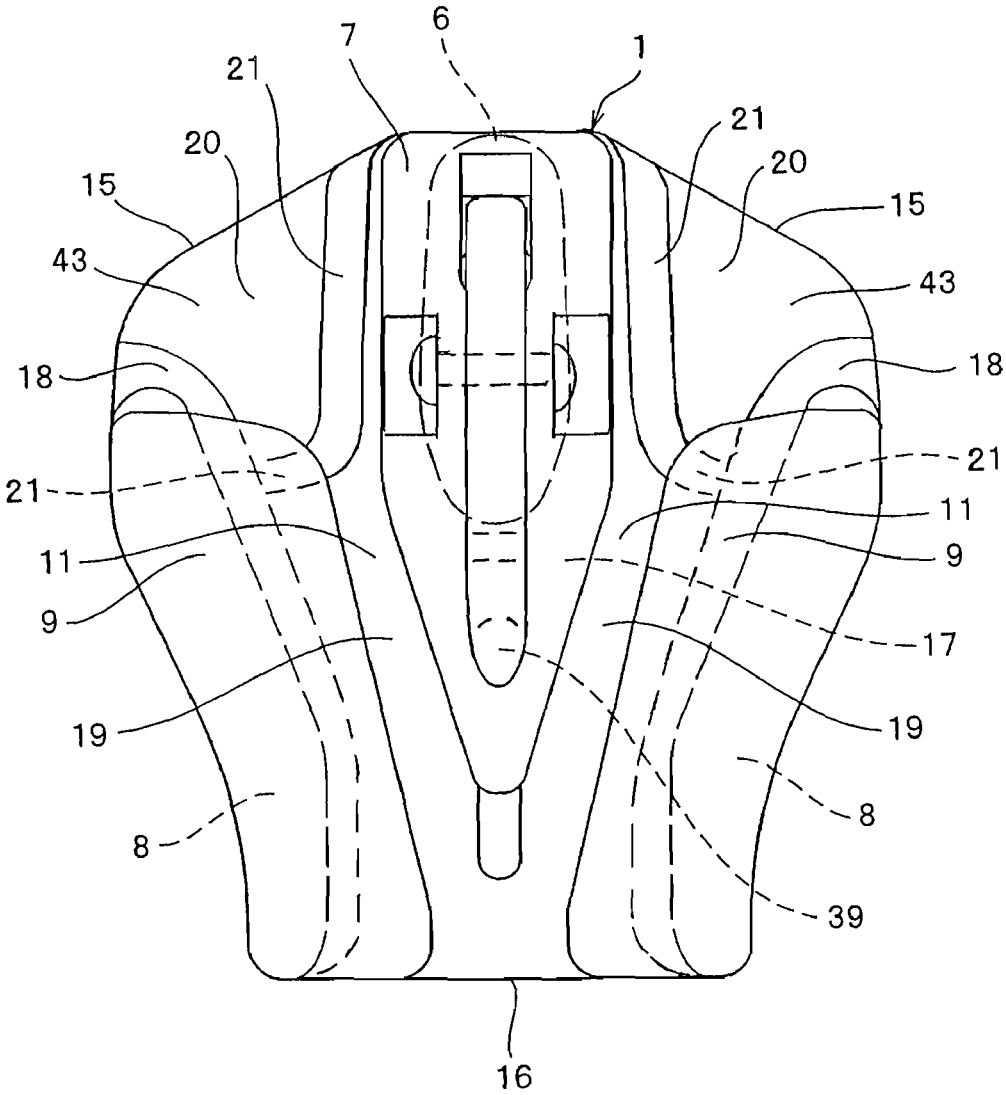
FIG. 9 is a plan view of the slider.
Figure 10:
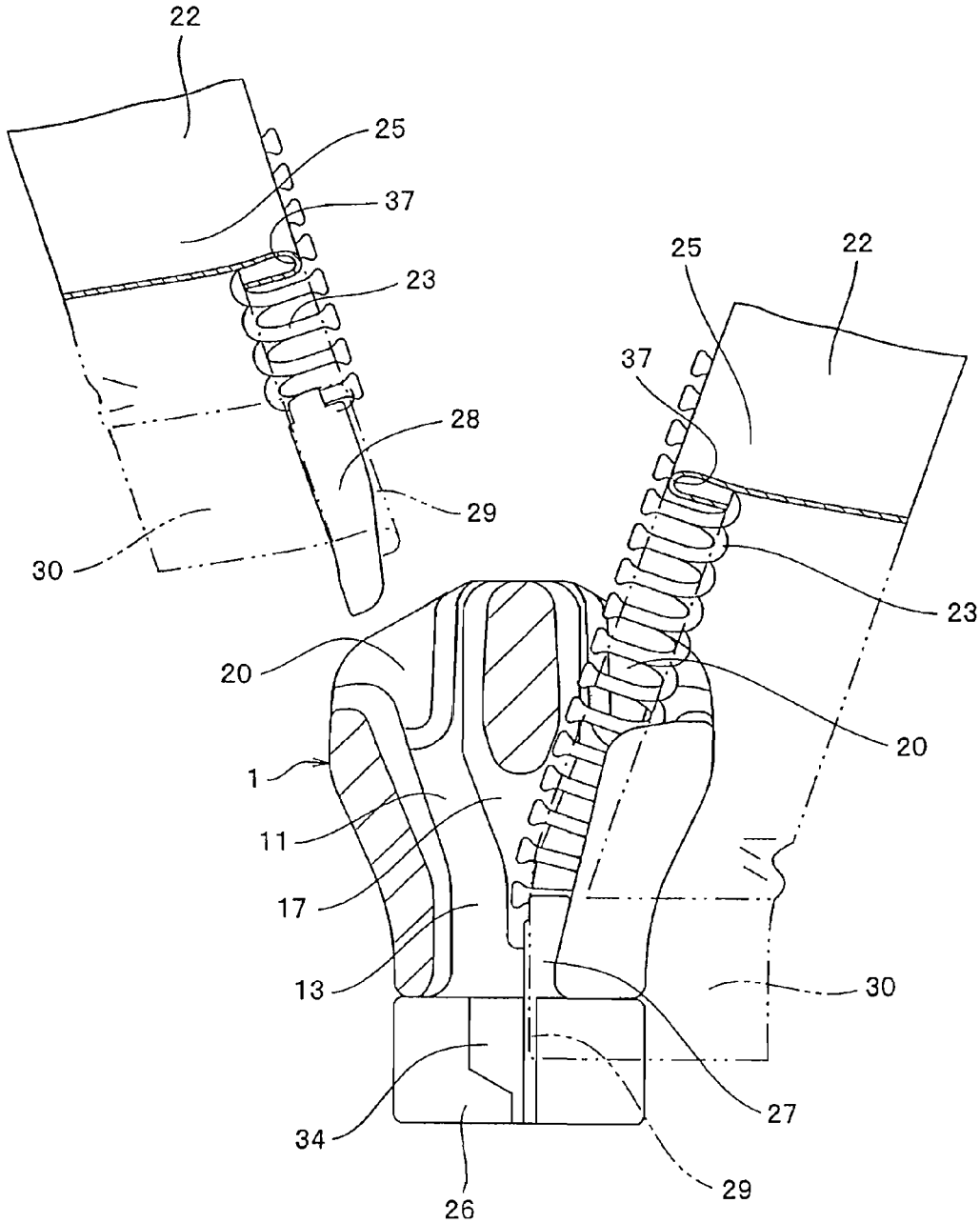
FIG. 10 is a plan view showing a usage condition of the slider.
Figure 11:
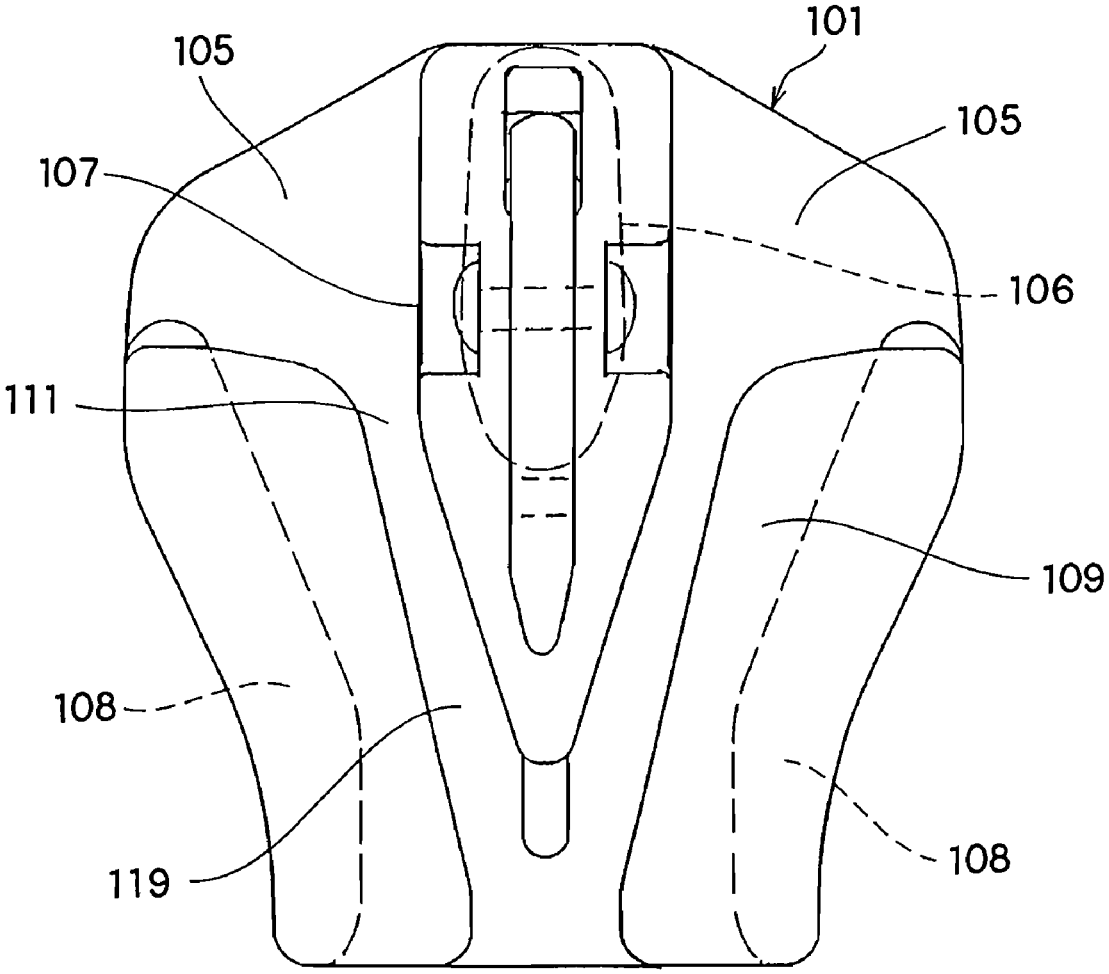
FIG. 11 PRIOR ART
FIG. 11 is a plan view of a known concealed type slider.
Figure 12:
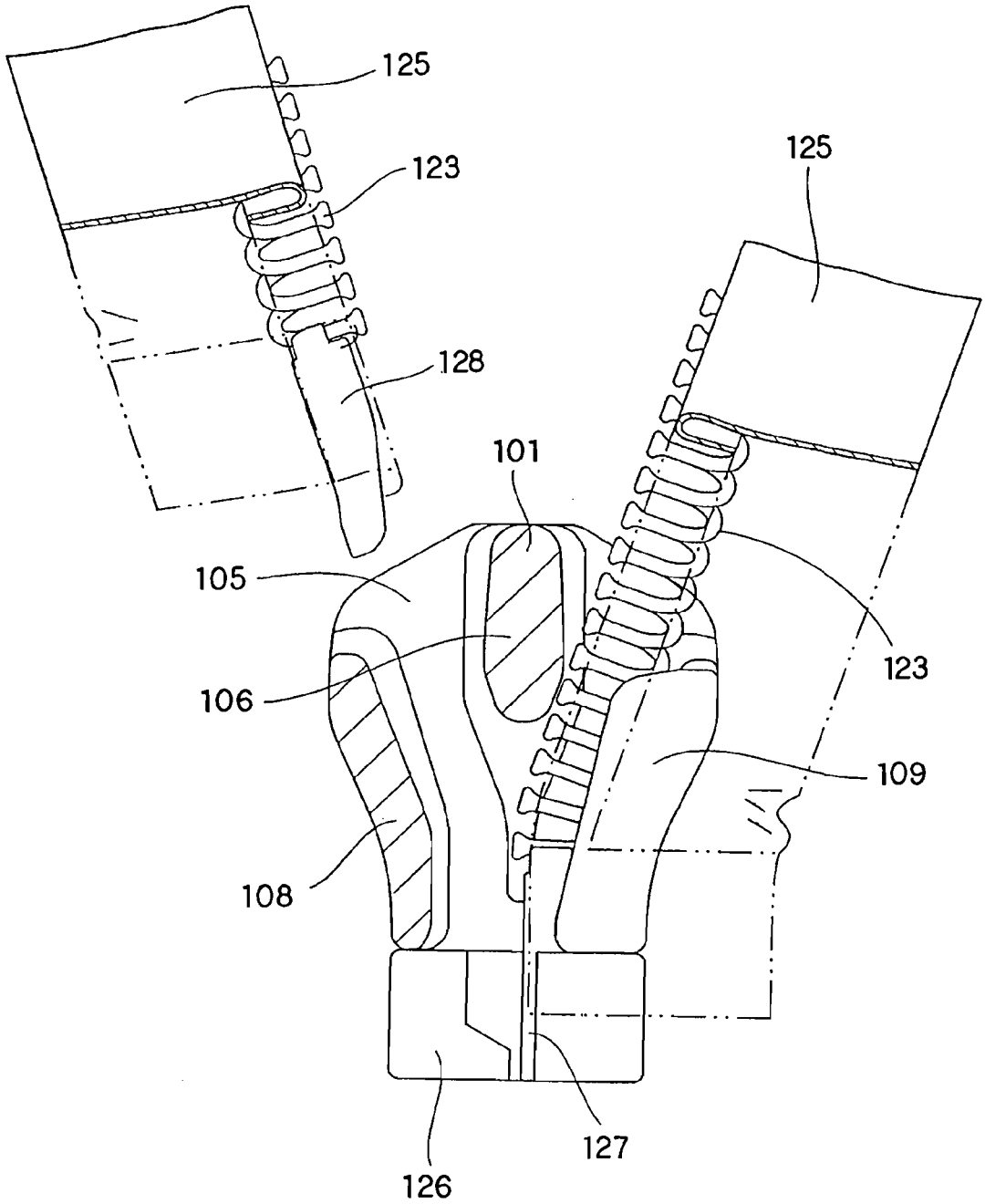
FIG. 12 PRIOR ART
FIG. 12 is a plan view showing a usage condition of the known slider.
Figure 13:
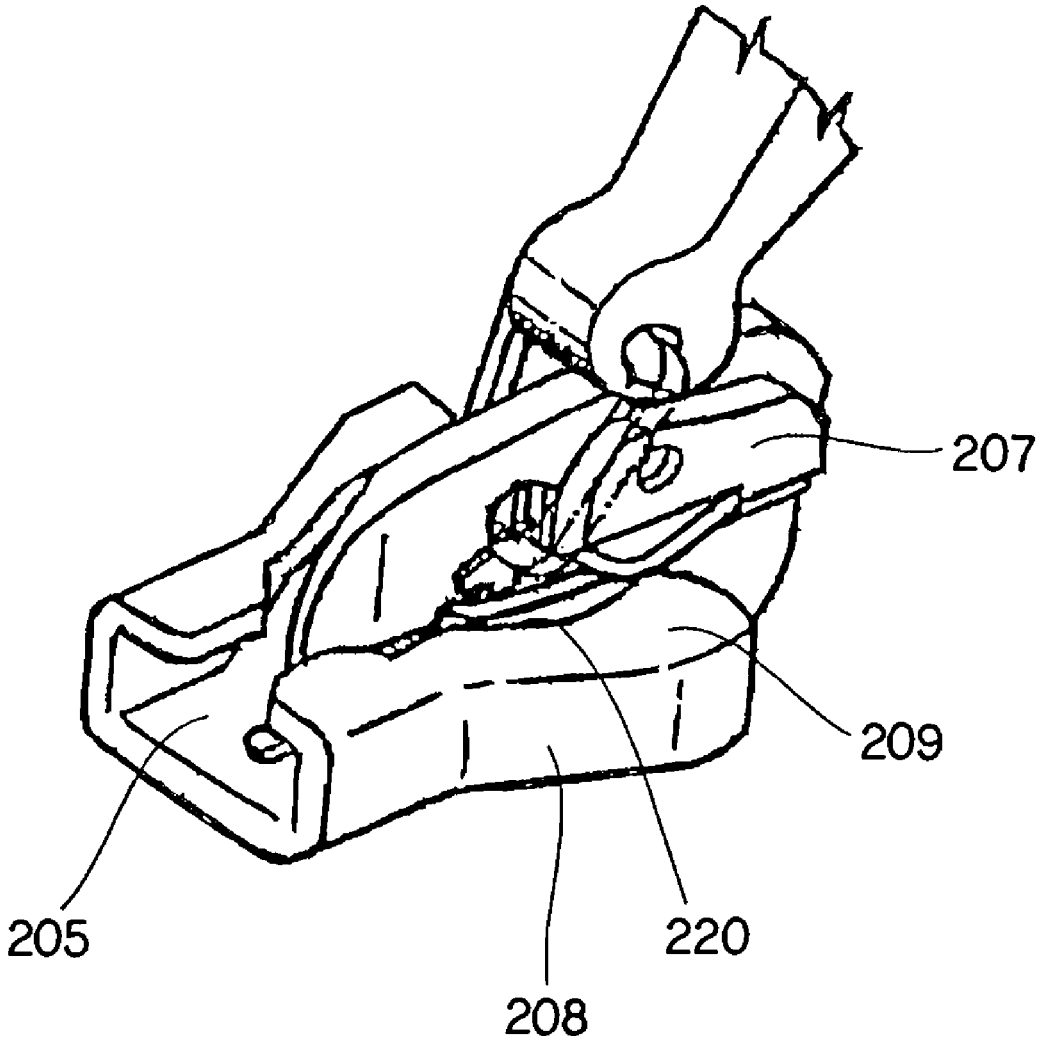
FIG. 13 PRIOR ART
FIG. 13 is a perspective view of another known concealed type slider.

In a slider for a concealed type slide fastener with a separable bottom end stop of a second embodiment shown in FIG. 8 to FIG. 10, the basic shape that the diamond 6 is erected on the lower blade 5 of the body 2 of the slider 1 such that the diamond 6 is extended from the center of the shoulder mouth 15 toward the rear mouth 16 and that the flanges 8 are provided curvedly on both sides of the lower blade 5 is the same as the slider 1 of the first embodiment. The second embodiment is different from the first embodiment in that the recesses 20 are provided concavely in the lower blades 5 of the guide grooves 12, 13 on both sides of the diamond 6 symmetrically. Other structure than this one is the same as the structure of the slider 1 shown in the first embodiment.

The diamond 6 is erected in the center of the shoulder mouth 15 of the lower blade 5 and the insertion grooves 12, 13 for inserting the box pin 27 and the insert pin 28 are provided on both sides of this diamond 6. One of the insertion grooves 12, 13 is adopted as the box pin insertion groove 12 while the other is adopted as the insert pin insertion groove 13. The reason why the insertion grooves 12, 13 are not distinguished between for the box pin and for the insert pin is that while one insertion groove is adopted for the insert pin, the insert pin 28 is used exclusively for right side insertion or for left side insertion depending on each area of the world. Because which is used is distinguished depending on the area of the world, this can be adopted for both right side insertion and left side insertion if the recesses 20 are provided in both the insertion grooves 12 and 13 from the beginning. Thus, the recess 20 is provided concavely in both the insertion grooves 12 and 13.

The concealed type slide fastener chain of the present invention is constructed by, as the fastener elements 23, forming continuous elements into a coil shape or zigzag shape of polyamide or polyester monofilament or attaching independent elements formed of metal or resin on the side edge of the fastener tape. Further, the materials of the separable bottom end stop and slider may be substituted by resin instead of metal.

The slider for the concealed type slide fastener with the separable bottom end stop of the present invention is applicable for openings of articles which take design thereof as important, such as clothes, particularly, coat, suit, one-piece suit, and jacket.

What is claimed is:

1. A slider for a concealed type slide fastener having a separable bottom end stop, comprising:

a main body of the slider including a lower blade, right and left flanges which rise integrally upward along side edges in a lateral direction of the lower blade, a diamond which integrally rises upward from the lower blade at the center in a lateral direction of a shoulder mouth of the lower blade, a tab attaching portion which is formed on the diamond, and right and left upper blades which are extended horizontally from upper ends of the right and left flanges toward side faces of the tab attaching portion, and wherein a Y-shaped guide groove is formed from an end portion of the shoulder mouth to an end portion of a rear mouth in an inner face of the lower blade, fastener tape insertion passages are provided between the diamond and the right and left upper blades, and a recess is provided concavely in the Y-shaped guide groove such that the recess is extended from the end portion of the shoulder mouth toward the rear mouth side, wherein a sidewall of the recess has a first portion on the diamond side which extends in a direction parallel to a sliding direction of the slider and a second portion on the rear mouth side which extends in a direction perpendicular to the sliding direction of the slider, and wherein the first portion and the second portion of the side wall are sloped toward a bottom face of the recess.

2. The slider for a concealed type slide fastener having a separable bottom end stop according to claim 1, wherein the recess is provided within a range sideways of the diamond.

3. The slider for a concealed type slide fastener having a separable bottom end stop according to claim 1, wherein the recess is formed such that the width thereof is decreased gradually from the shoulder mouth toward the rear mouth side.

4. The slider for a concealed type slide fastener having a separable bottom end stop according to claim 1, wherein the recess is provided sideways of the diamond and formed concavely between an intermediate partition provided sideways of the diamond on the shoulder mouth side and a proximal portion of a corner of one of the right and left flanges.

5. The slider for a concealed type slide fastener having a separable bottom end stop according to claim 1, further comprising another recess, wherein the recesses are formed in the lower blade on both sides of the diamond so as to be able to cope with right side insertion and left side insertion of an insert pin.

6. The slider for a concealed type slide fastener having a separable bottom end stop according to claim 1, wherein the second portion of the side wall is disposed from the first portion of the side wall to a proximal portion of one of the right and left flanges.

* * * * *